US010925380B1

(12) United States Patent
Nelson

(10) Patent No.: US 10,925,380 B1
(45) Date of Patent: Feb. 23, 2021

(54) BEVERAGE HOLDER

(71) Applicant: Steven A. Nelson, Lakeside Park, KY (US)

(72) Inventor: Steven A. Nelson, Lakeside Park, KY (US)

( * ) Notice: Subject to any disclaimer, the term of this patent is extended or adjusted under 35 U.S.C. 154(b) by 0 days.

(21) Appl. No.: 16/402,428

(22) Filed: May 3, 2019

(51) Int. Cl.
*A47G 23/02* (2006.01)
*A45F 3/18* (2006.01)

(52) U.S. Cl.
CPC ..... *A45F 3/18* (2013.01); *A47G 23/02* (2013.01); *A47G 23/0208* (2013.01); *A63B 2225/682* (2013.01)

(58) Field of Classification Search
CPC ..... A45F 3/18; A45F 2200/0583; A45F 2200/05; A63B 2225/682; A47G 23/02; A47G 23/0208; A47G 23/0216; A47G 23/0225; B60N 3/10
USPC ..... 248/311.2, 312.1, 310, 309.1, 312, 248/220.21, 220.42, 220.43, 220.41, 248/223.41
See application file for complete search history.

(56) References Cited

U.S. PATENT DOCUMENTS 1,219,025 A * 3/1917 Mertz ..... A47B 96/022 248/220.1
1,983,060 A * 12/1934 Zuckerman ..... B60N 3/101 248/225.11
3,939,986 A 2/1976 Pierro
4,619,428 A * 10/1986 Bailey ..... A47F 5/0823 248/220.43
4,655,425 A * 4/1987 Wallace ..... B60N 3/18 248/308
4,702,446 A * 10/1987 Brown ..... E06C 7/143 182/129
4,997,157 A * 3/1991 Sweeny ..... A62C 13/78 248/310
5,996,957 A * 12/1999 Kurtz ..... A47G 23/0225 248/231.21
6,264,153 B1 7/2001 Ragner et al.
6,457,772 B1 * 10/2002 Forston ..... A47C 7/62 297/188.04
7,234,673 B2 * 6/2007 Graneto, III ..... B65D 83/386 220/751
7,533,860 B2 * 5/2009 Somuah ..... B60N 3/102 248/311.2
8,033,518 B2 * 10/2011 Schuchman ..... B60N 3/103 248/311.2
8,146,614 B2 4/2012 Ford et al.
(Continued)

OTHER PUBLICATIONS

Kruzer Kaddy—#200—Kruzer Kaddy, Chrome. Product listing [online]. Copyright © 1995-2019 eBay Inc., [retrieved on Oct. 15, 2018]. Retrieved from the Internet: <URL:https://www.ebay.com/p/Kruzer-Kaddy-200-Kruzer-Kaddy-Chrome/171223203?iid=123743496991&rt=nc>.
(Continued)

*Primary Examiner* — Nkeisha Smith
(74) *Attorney, Agent, or Firm* — Cramer Patent & Design, PLLC; Aaron R. Cramer

(57) ABSTRACT

A beverage holder includes a cup having a support base, a bracket portion capable of providing a cantilevered support of the holder to a support structure, and a peg capable of insertion into a bore hole for support of the holder to a support structure. The holder is particularly suited for support on a piece of exercise equipment.

20 Claims, 8 Drawing Sheets

(56) References Cited

U.S. PATENT DOCUMENTS

| | | | | |
|---|---|---|---|---|
| 8,245,894 | B2 * | 8/2012 | Buehler | B62B 3/1472 224/411 |
| 8,382,053 | B2 * | 2/2013 | Webb | A47G 23/02 248/311.2 |
| 8,636,319 | B1 | 1/2014 | Parker, Jr. | |
| 9,072,637 | B1 * | 7/2015 | Puri | A61J 1/16 |
| 9,399,479 | B1 | 7/2016 | Chen | |
| 9,950,731 | B2 | 4/2018 | Kim et al. | |
| 10,143,614 | B1 * | 12/2018 | Pelletier | A61H 3/02 |
| 2016/0171913 | A1 * | 6/2016 | Sprinkle | A47G 23/0216 248/558 |

OTHER PUBLICATIONS

Ram Mounts—Level Cup Drink Holder and Koozie Bar Mount. Product listing [online]. Copyright © 2019 BTO Sports, [retrieved on Oct. 15, 2018]. Retrieved from the Internet: <URL:https://www.btosports.com/atv/ram-mounts-level-cup-drink-holder-and-koozie>.

Barefoot Willies Cup Holder All Bar Sizes + Goldwing Lifetime Guarantee,coozee. Product listing [online]. Copyright © 1995-2019 eBay Inc., [retrieved on Oct. 15, 2018]. Retrieved from the Internet: <URL:https://www.ebay.com/itm/Barefoot-Willies-Cup-Holder-All-Bar-Sizes-Goldwing-Lifetime-Guarantee-coozee-/282060102260>.

* cited by examiner

BEVERAGE HOLDER

FIELD OF THE INVENTION

The presently disclosed subject matter is directed to a beverage holder. Specifically, a beverage holder particularly suited for support on a piece of exercise equipment.

BACKGROUND OF THE INVENTION

Many people consume water or other beverages such as juice, dietary supplements, tea or the like as part of their regular exercise workout. These beverages are typically provided in bottles, cans, reusable cups, or even insulated containers that the user likes to keep close at hand during strenuous workouts.

While many pieces of exercise equipment such as bikes and treadmills provide cup holders for this purpose, they are strangely absent from power racks or squat racks. As such, the user may be forced to keep such beverage containers far away, which reduces the tendency to frequently drink from them, or risk keeping they nearby on the floor where they can become contaminated or accidentally kicked over resulting in a messy spill. Accordingly, there exists a need for a means by which a beverage container can be easily held on power racks in a gym environment to avoid the problems as described above. The development of the beverage holder fulfills this need.

SUMMARY OF THE INVENTION

The principles of the present invention provide for a beverage holder, comprising a cup resting on a base portion. The cup has a diameter, a cup bottom wall with a cup bottom wall upper surface, a cup wall bottom surface, an interior, and an upper perimeter edge circumscribed with a cup rim. The cup bottom wall bottom surface is affixed to the base such that it rests on the base upper surface of the base portion. The base portion has a planar base front surface, a planar base top surface upon which the cup bottom wall bottom surface rests, a planar base bottom surface opposite the base top surface, a planar base right side surface and a planar base left side surface opposite the base right side surface.

The beverage holder also comprises a back-plate portion which is attached to the cup and the base portion. The back-plate portion is affixed to the base portion at a perpendicular orientation and parallel with the cup sidewall. The back-plate portion has a planar back-plate front surface lower portion continuous with the base top surface, a planar back-plate right side surface, and a planar back-plate left side surface opposite the back-plate right side surface.

The beverage holder also comprises a planar projection portion which spans the width between the back-plate right side surface and the back-plate left side surface. The planar projection portion has a front surface attached to a rear portion of the cup rim, superjacent the projection portion is a stepped portion that gradually tapers down in a plurality of stepped elements to a planar back-plate front surface upper portion, and a planar back-plate rear surface is opposite the back-plate front surface lower portion, the projection portion, the stepped portion, and the back-plate front surface upper portion.

The beverage holder also comprises a peg which is attached to the back-plate portion. The peg is affixed to a location on the back-plate rear surface and extends rearwardly therefrom. The peg is located along a longitudinal centerline bisecting the back-plate rear surface to provide proper balance when the holder is suspended from a support surface via the peg.

The beverage holder also comprises a bracket portion which is attached to and extends rearwardly from the back-plate rear surface, subjacent the peg and opposite the back-plate front surface lower portion. The bracket portion has a bracket side portion that is affixed to the back-plate portion at a perpendicular angle. The bracket side portion has a planar bracket side portion left side surface that is coextensive with the back-plate left side surface and a planar bracket side portion right side surface opposite the bracket side portion left side surface. The bracket side portion also has a planar bracket side portion bottom surface coextensive with the base bottom surface, and a planar bracket side portion upper surface, opposite the bracket side portion bottom surface. The bracket portion also has a rear portion that is affixed to the terminal end of the side portion of the bracket portion and extends away perpendicularly therefrom. The bracket rear portion also has a planar bracket rear portion upper surface that is coextensive with the bracket side portion upper surface and a planar bracket rear portion bottom surface, opposite the bracket rear portion upper surface, that is continuous with the bracket side portion bottom surface. The bracket rear portion also has a planar bracket rear portion front surface coextensive with the bracket side portion right side surface and faces the back-plate rear surface. A planar bracket rear portion rear surface is located opposite the bracket rear portion front surface, and the bracket rear portion also has a bracket rear portion right side surface which is opposite the bracket side portion left side portion.

The cup may also comprise a cup sidewall that is generally cylindrical in shape while the cup rim may have a rear portion that is affixed with a projection surface of the back-plate portion. The cup rim may have a rear portion that is integral with a projection surface of the back-plate portion. The cup bottom wall may gently transition from the cup sidewall such that the interior surface of the cup sidewall and the cup bottom wall upper surface is a smooth and continuous surface and does not have any sharp corners.

The cup bottom wall may have an overall diameter which is slightly greater than the width of the base portion, such that a portion of the cup bottom wall bottom surface is visible in a bottom plan view of the holder. The cup interior may be defined by the cup bottom wall, the cup sidewall and a planar area between inner edges of the cup rim. The base portion may be generally square and has a width slightly less than the diameter of the cup. The base portion may generally be rectangular and has a width slightly less than the diameter of the cup.

The back-plate front surface upper portion may have a thickness less than that of the back-plate front surface lower portion. While the back-plate front surface lower portion has a thickness equal to that of the base portion, such that the back-plate right side surface is continuous with the base right side surface and the back-plate left side surface is continuous with the base left side surface at this location. The back-plate right side surface and the back-plate left side surface may remain planar and follows the overall thickness of the back-plate portion.

The beverage holder may also comprise a gap defined by the boundaries of the rear side of the cup sidewall, the rear of the cup rim, the projection portion, the back-plate front surface lower portion, and the base upper surface. The peg may be a cylindrical element with a terminal distal end, opposite the back-plate rear surface, that is smoothly rounded and has no sharp edges.

The beverage holder may comprise a terminal distal end which is configured to snugly insert the peg into a rounded bore hole. The peg may be located superjacent to the cup. The length the bracket side portion extends rearwardly away from the back-plate portion, and the length that the bracket rear portion extends away from the bracket side portion is defined as a bracket gap. The beverage holder is manufactured in a unitary fabrication and the cup, the base portion, the back-plate portion, the peg, and the bracket portion are integrally formed. The beverage holder may be manufactured in a unitary fabrication and the cup, the base portion, the back-plate portion, the peg, and the bracket portion are affixed, bonded, or attached to each other to provide an integral device.

The beverage holder may also be made of material selected from the group consisting of waterproof material, inert material, resilient to damage material, resistant to staining material, and capable of being easily cleaned material.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
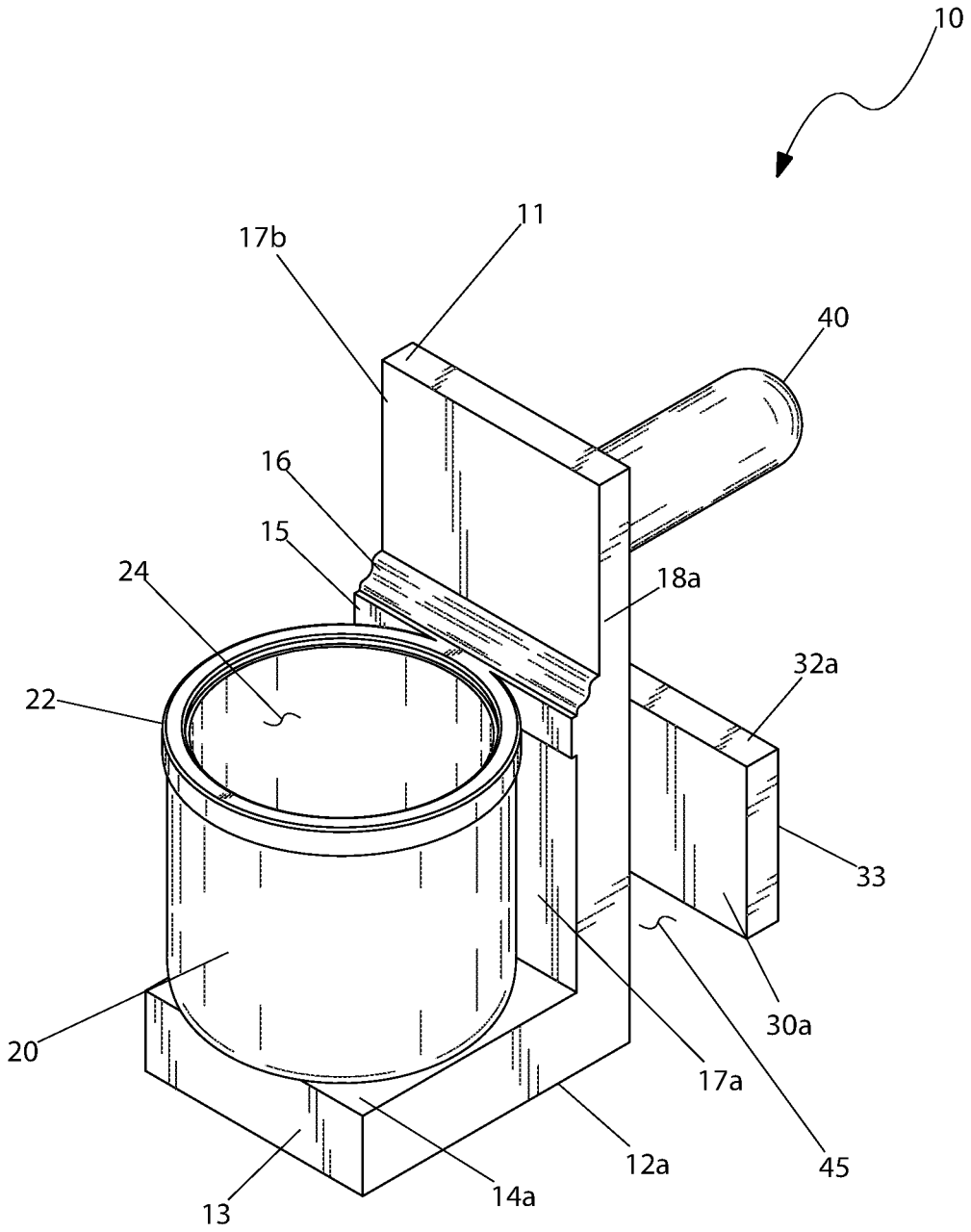
FIG. 1 is a top front perspective view of a beverage holder 10, according to a preferred embodiment of the present invention.

10 beverage holder
11 back-plate upper surface
12*a* base right side surface
12*b* base left side surface
13 base front surface
14*a* base upper surface
14*b* base bottom surface
15 projection portion
16 stepped portion
17*a* back-plate front surface lower portion
17*b* back-plate front surface upper portion
17*c* back-plate rear surface
18*a* back-plate right side surface
18*b* back-plate left side surface
20 cup sidewall
22 cup rim
24 cup interior
25*a* cup bottom wall upper surface
25*b* cup bottom wall bottom surface
30*a* bracket rear portion front surface
30*b* bracket rear portion rear surface
31 bracket side portion left side surface
32*a* bracket rear portion upper surface
32*b* bracket side portion upper surface
33 bracket rear portion right side surface
34*a* bracket rear portion bottom surface
34*b* bracket side portion bottom surface
35 bracket side portion right side surface
40 peg
45 bracket gap

DESCRIPTION OF THE PREFERRED EMBODIMENTS

Figure 2:
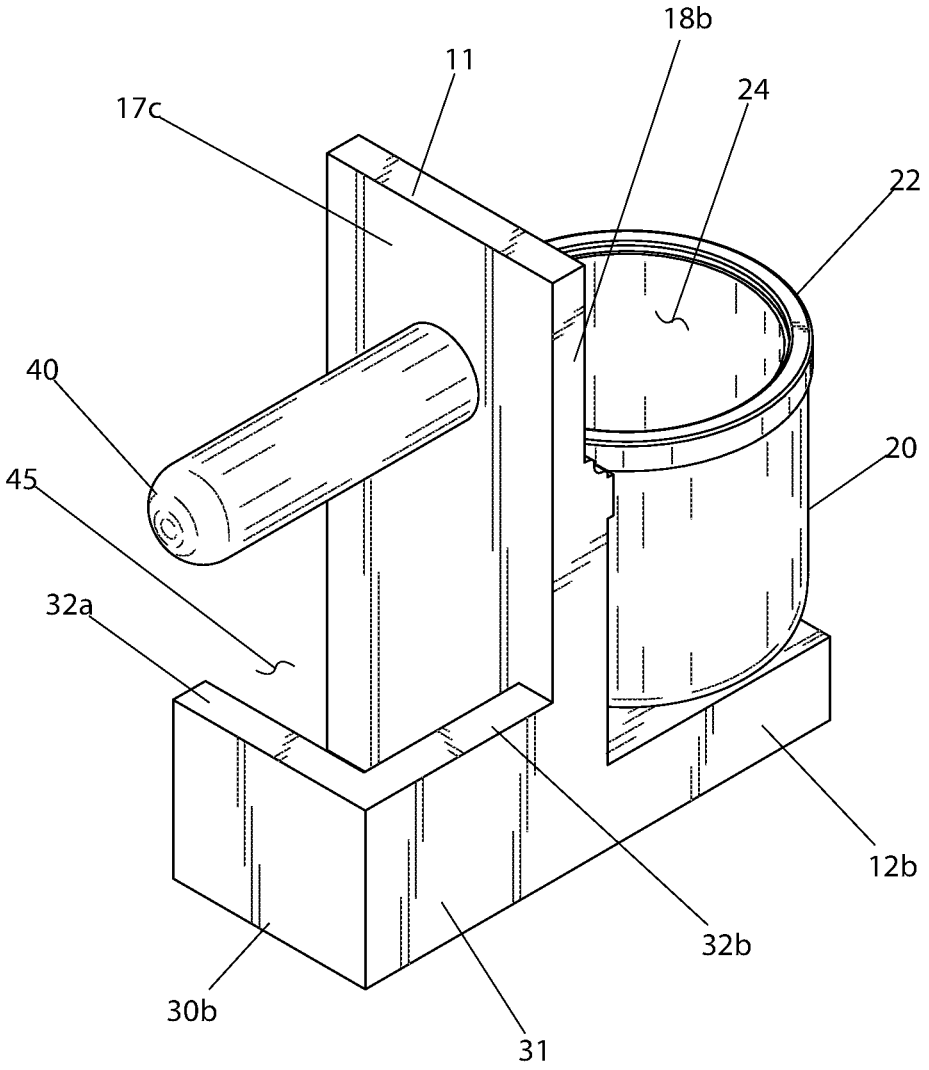
FIG. 2 is a top rear perspective view of the beverage holder 10, according to a preferred embodiment of the present invention.
Figure 3:
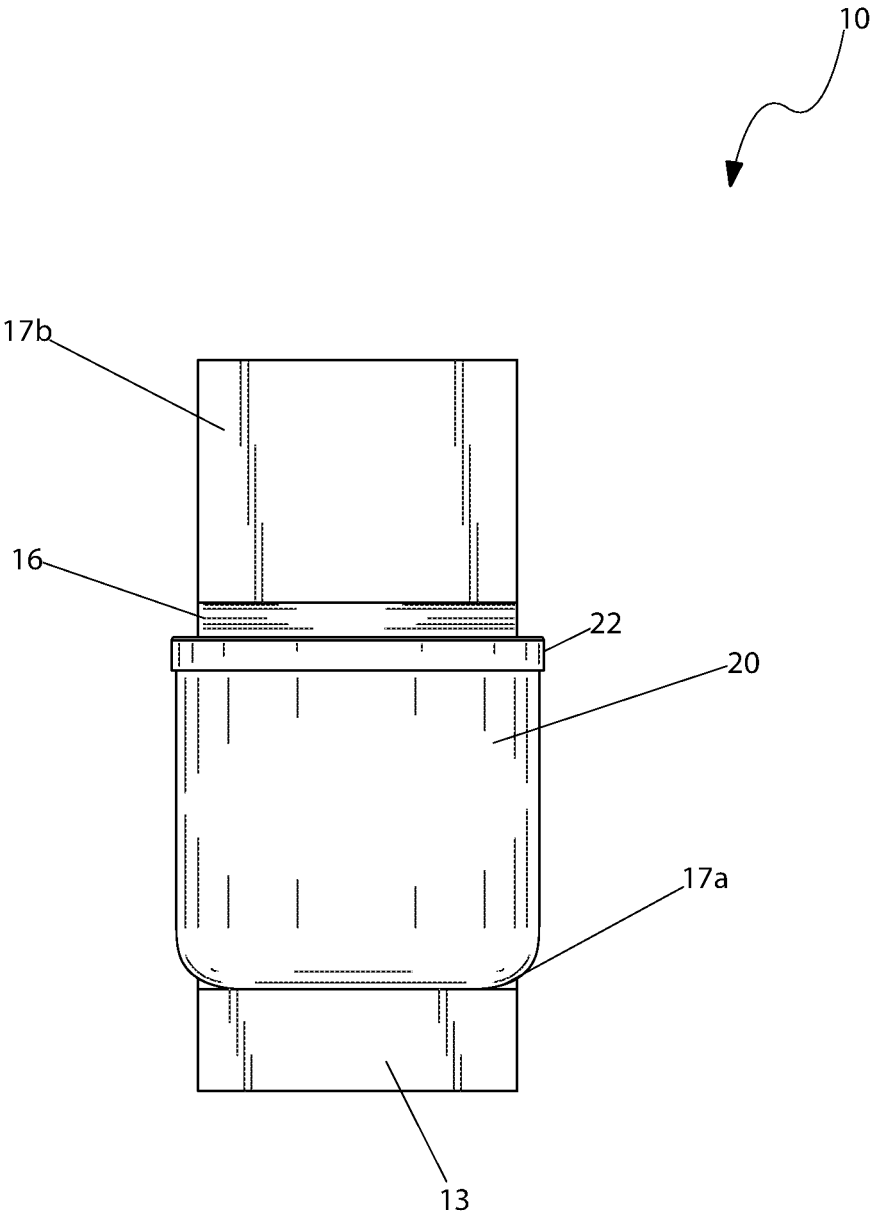
FIG. 3 is a front elevation view of the beverage holder 10, according to the preferred embodiment of the present invention.
Figure 4:
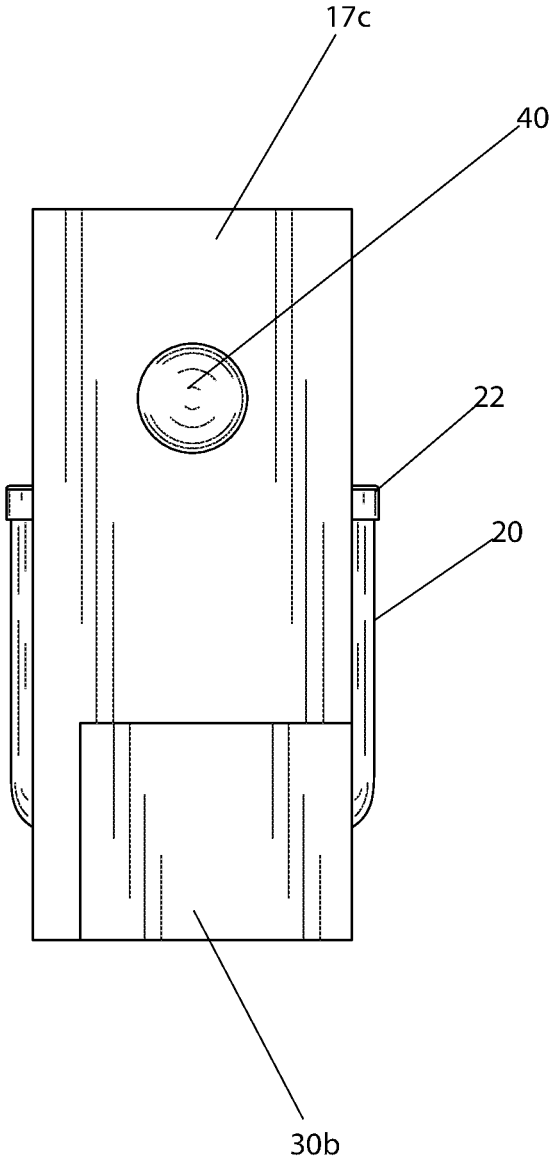
FIG. 4 is a rear elevation view of the beverage holder 10, according to the preferred embodiment of the present invention.
Figure 5:
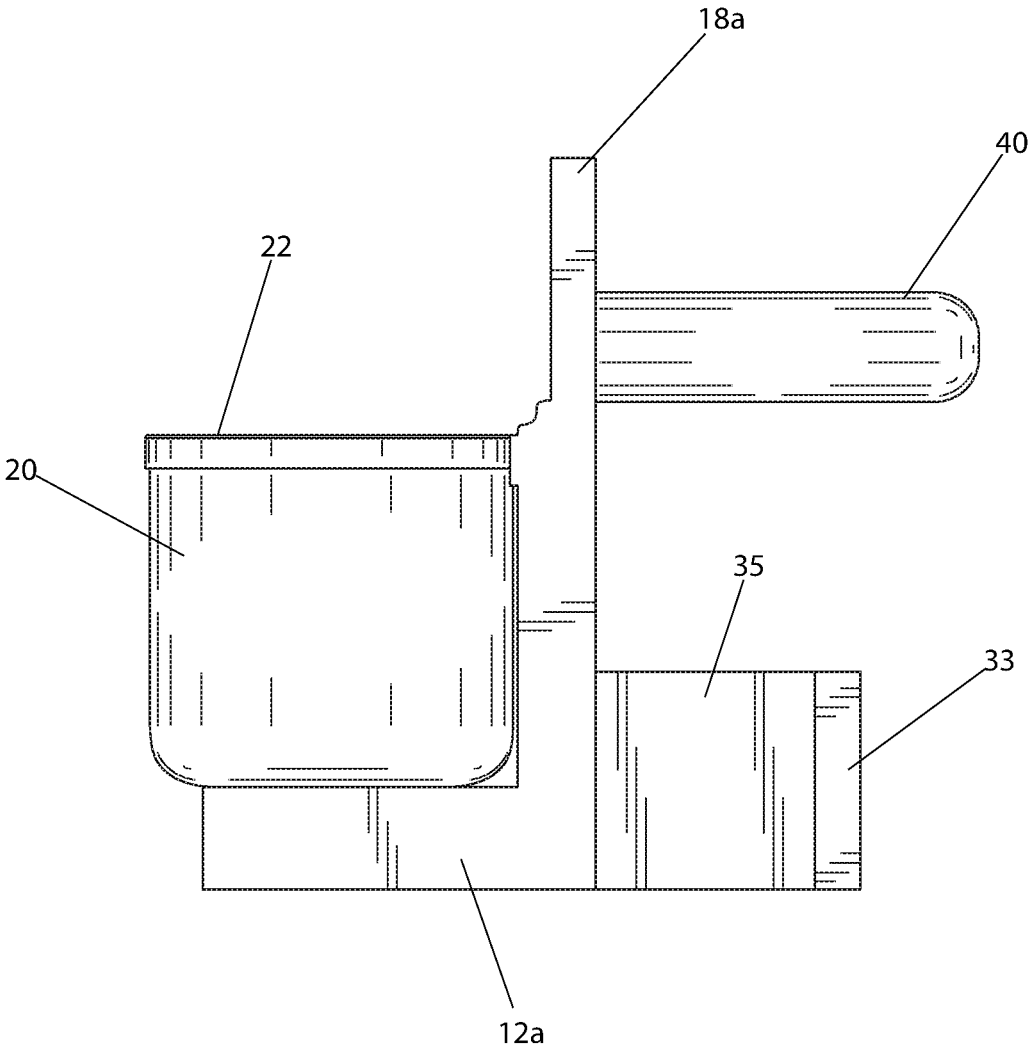
FIG. 5 is a right side elevation view of the beverage holder 10, according to the preferred embodiment of the present invention.
Figure 6:
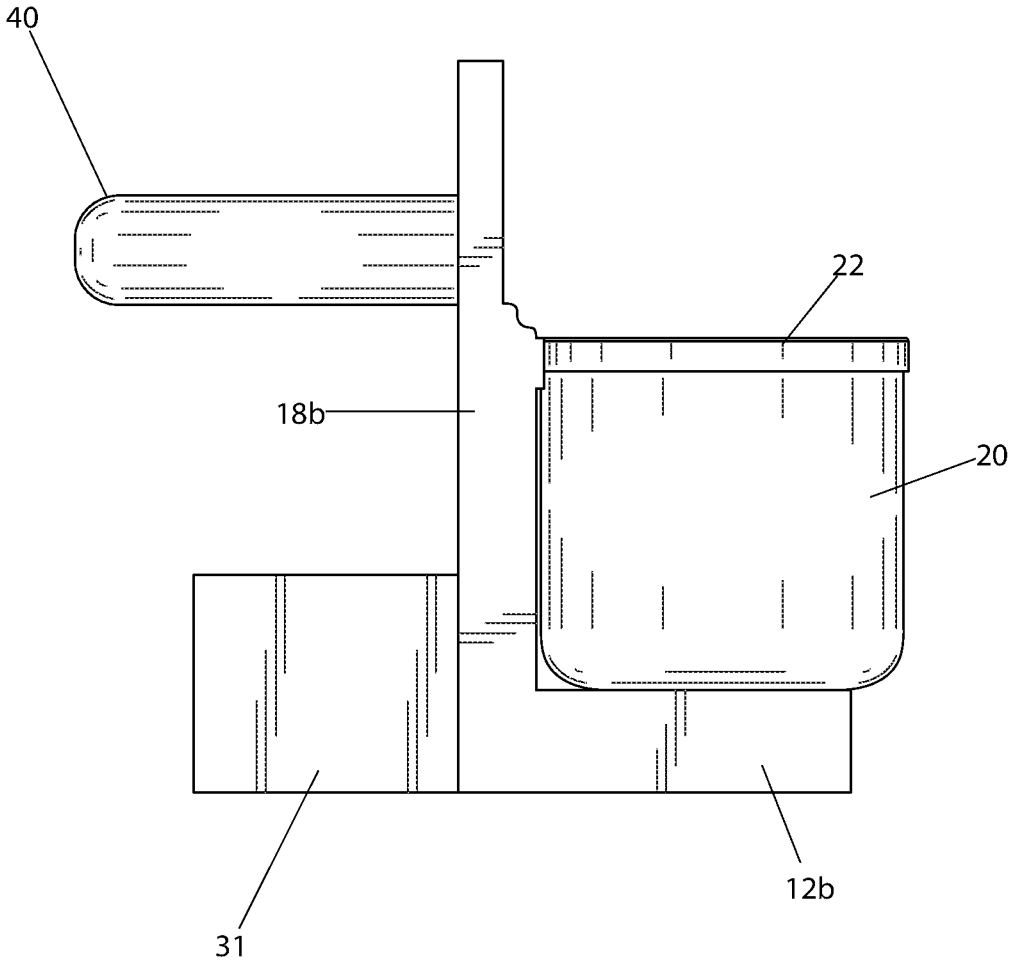
FIG. 6 is a left side elevation view of the beverage holder 10, according to an alternate embodiment of the present invention.
Figure 7:
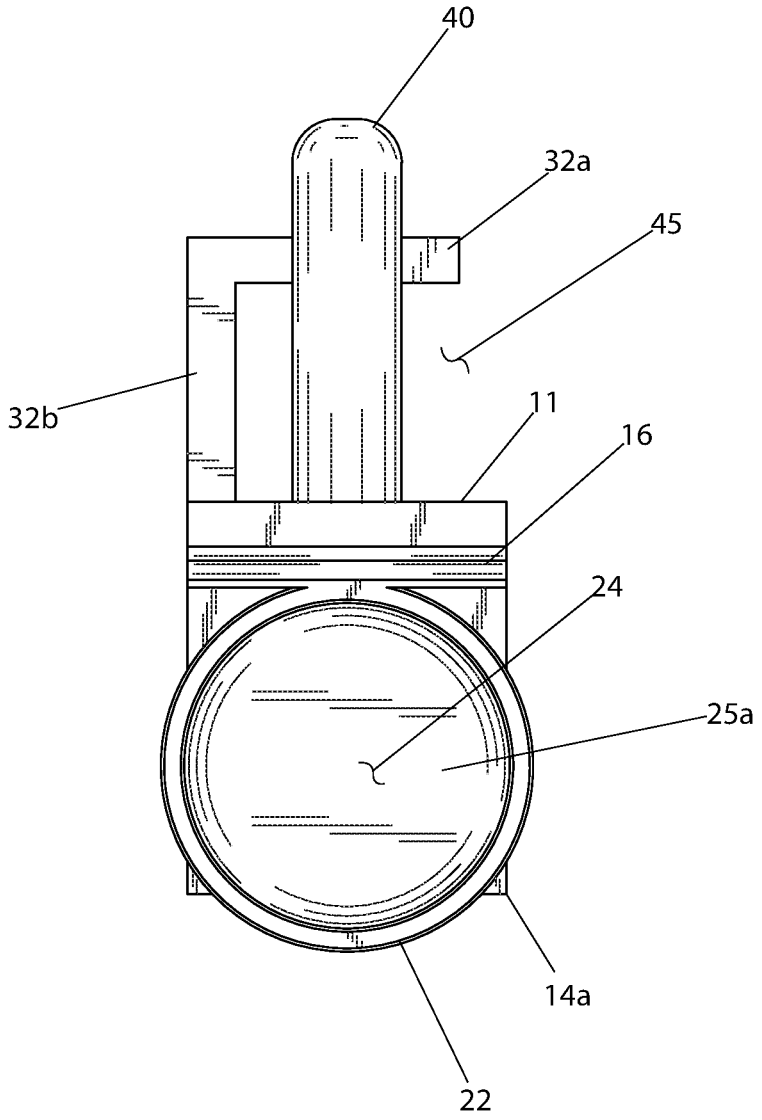
FIG. 7 is a top plan view of the beverage holder 10, according to the preferred embodiment of the present invention; and, FIG. 8 is a bottom plan view of the beverage holder 10, according to an alternate embodiment of the present invention.
Figure 8:
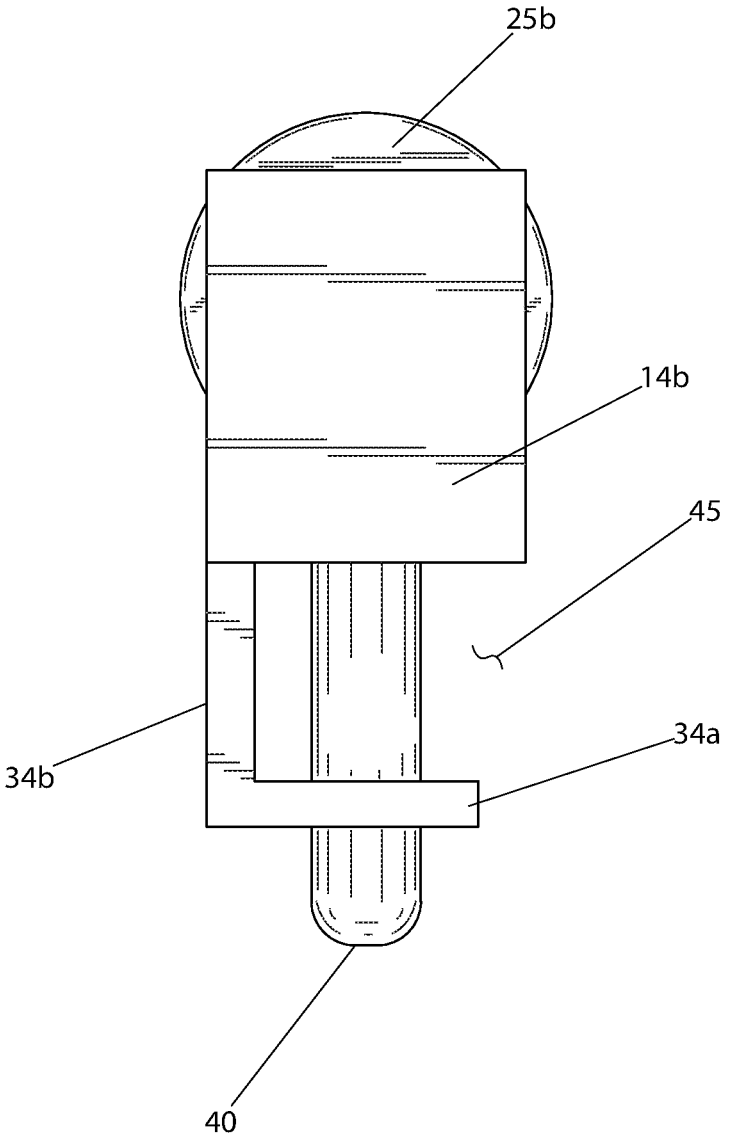

The best mode for carrying out the invention is presented in terms of its preferred embodiment, herein depicted within FIGS. 1 through 8. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIGS. 1-8, various views of the beverage holder (herein described as the "holder") 10, is shown. The holder 10 includes a cup that rests on a base portion, a back-plate portion attached to the cup and base portion, a peg 40 attached to the back-plate portion, and a bracket portion attached to the back-plate portion. It is appreciated that the beverage holder 10 can be manufactured in a unitary fabrication where the cup, base portion, back-plate portion, peg 40, and bracket portion are integrally formed, or it can be constructed in such manner that the cup, base portion, back-plate portion, peg 40, and bracket portion are affixed, bonded, or otherwise attached to each other to provide an integral device. Such materials are preferably waterproof, inert, resilient to damage, resistant to staining, and capable of being easily cleaned.

The cup includes a cup sidewall 20 that is generally cylindrical in shape, having a diameter, and having an upper perimeter edge circumscribed 5 with a cup rim 22. The cup rim 22 has a rear portion that is affixed or integral with a projection portion 15 of the back-plate portion. The cup rim 22 has a slightly greater diameter that that of the cup sidewall 20. The cup has a cup bottom wall with a cup bottom wall upper surface 25*a* and a cup wall bottom surface 25*b*. The cup bottom wall bottom surface 25*b* is affixed to the base such that it rests on the base upper surface 14*a* of the base portion. The cup bottom wall gently transitions from the cup sidewall 20 such that the interior surface of the cup sidewall and the cup bottom wall upper surface 25*a* is a smooth and continuous surface and does not have any sharp corners. The cup bottom wall has an overall diameter slightly greater than the width of the base portion, such that a portion of the cup bottom wall bottom surface 25*b* is visible in a bottom plan view of the holder 10 (please refer to FIG. 8). A cup interior 24 is thus defined by the cup bottom wall, cup sidewall 20 and a planar area between inner edges of the cup rim 22.

The base portion is generally square or rectangular and has a width slightly less than the diameter of the cup. The base portion thus has a planar base front surface 13, a planar base top surface 14*a* upon which the cup bottom wall bottom surface 25*b* rests, a planar base bottom surface 14*b* opposite the base top surface 14*a*, a planar base right side surface 12*a* and a planar base left side surface 12*b* opposite the base right side surface 12*a*.

The back-plate portion is affixed to the base portion at a perpendicular orientation and parallel with the cup sidewall 20. The back-plate portion has a planar back-plate front surface lower portion 17*a* continuous with the base top surface 14*a*, a planar back-plate right side surface 18*a*, and a planar back-plate left side surface 18*b* opposite the back-plate right side surface 18*a*. A planar projection portion 15 spans the width between the back-plate right side surface 18*a* and the back-plate left side surface 18*b* and has a front surface attached to a rear portion of the cup rim 22. Superjacent the projection portion 15 is a stepped portion 16 that gradually tapers down in a plurality of stepped elements to a planar back-plate front surface upper portion 17*b*. The back-plate front surface upper portion 17*b* has a thickness less than that of the back-plate front surface lower portion 17*a*. A planar back-plate rear surface 17*c* is opposite the back-plate front surface lower portion 17*a*, projection portion 15, stepped portion 16, and back-plate front surface upper portion 17*b*.

The back-plate front surface lower portion 17*a* generally has a thickness equal to that of the base portion, such that the back-plate right side surface 18*a* is continuous with the base right side surface 12*a* and the back-plate left side surface 18*b* is continuous with the base left side surface 12*b* at this location. The back-plate right side surface 18*a* and back-plate left side surface 18*b* remains planar and follows the overall thickness of the back-plate portion. There is a gap defined by the boundaries of the rear side of the cup sidewall 20, the rear of the cup rim 22, the projection portion 15, the back-plate front surface lower portion 17*a*, and the base upper surface 14*a*.

A peg 40 is affixed to or otherwise attached to a location on the back-plate rear surface 17*c* and extends rearwardly therefrom (i.e. opposite the cup). The peg 40 is preferably located along a longitudinal centerline bisecting the back-plate rear surface 17*c* to provide proper balance when the holder 10 is suspended from a support surface via the peg 40. The peg 40 is preferably a cylindrical element with a terminal distal end, opposite the back-plate rear surface 17*c*, that is smoothly rounded and has no sharp edges. The shape of this terminal end is configured to snugly insert the peg 40 (and thus the holder 10) into a rounded bore hole, similar to a rack of exercise equipment. The peg 40 location is located superjacent to the cup.

The bracket portion is attached to and extends rearwardly from the back-plate rear surface 17*c*, subjacent the peg 40, and opposite the back-plate front surface lower portion 17*a*. The bracket portion generally has the same thickness of the base portion and the lower portion of the back-plate portion.

The bracket portion has a bracket side portion that is affixed to the back-plate portion at a perpendicular angle. The bracket side portion has a planar bracket side portion left side surface 31 that is coextensive with the back-plate left side surface 18*b* and a planar bracket side portion right side surface 35 opposite the bracket side portion left side surface 31. The bracket side portion also has a planar bracket side portion bottom surface 34*b* coextensive with the base bottom surface 14*b*, and a planar bracket side portion upper surface 32*b*, opposite the bracket side portion bottom surface 14*b*.

The bracket portion also has a rear portion that is affixed to the terminal end of the side portion of the bracket portion and extends away perpendicularly therefrom. The bracket rear portion has a planar bracket rear portion upper surface 32*a* that is coextensive with the bracket side portion upper surface 32*b* and a planar bracket rear portion bottom surface 34*a*, opposite the bracket rear portion upper surface 32*a*, that is continuous with the bracket side portion bottom surface 34*b*. The bracket rear portion also has a planar bracket rear portion front surface 30*a* coextensive with the bracket side portion right side surface 35 and faces the back-plate rear surface 17*c*. Further, a planar bracket rear portion rear surface 30*b* is located opposite the bracket rear portion front surface 30*a*. The bracket rear portion also has a bracket rear portion right side surface 33 which is opposite the bracket side portion left side portion 31.

The width of the rear portion is oriented parallel with the width of the back-plate portion and is preferably not as wide thereas. Therefore, the bracket rear portion right side surface 33 terminates at a smaller distance than the back-plate right side surface 18*a*. The length that the bracket side portion extends rearwardly away from the back-plate portion, and the length that the bracket rear portion extends away from the bracket side portion can be defined as a bracket gap 45, which is generally configured to enable placement about a piece of exercise equipment, such as squat racks, so that the cup is parallel to the ground surface.

2. Operation of the Preferred Embodiment

In a preferred method of operation, it is determined that the holder 10 can be held by a user of supported on a support surface, either by the bracket portion (i.e., the bracket side portion and bracket rear portion at least partially engages a portion of the support surface or the bracket gap 45 receives a portion of the support surface), or by partial or full insertion of the peg 40 into a bore hole portion of the support surface. Such a support surface as previously identified can be a piece of exercise equipment. A beverage or a beverage container can be placed in the cup portion of the holder 10 and supported by any of the methods previously mentioned.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A beverage holder, comprising:

a cup resting on a base portion, the cup having a diameter, a cup bottom wall with a cup bottom wall upper surface, a cup wall bottom surface, an interior, and an upper perimeter edge circumscribed with a cup rim, a cup bottom wall bottom surface is affixed to the base such that it rests on a base upper surface of the base portion upon which the cup bottom wall bottom surface rests, the base portion has a planar base front surface, a planar base bottom surface opposite the base top surface, a planar base right side surface and a planar base left side surface opposite the base right side surface;

a back-plate portion attached to the cup and the base portion, the back-plate portion is affixed to the base portion at a perpendicular orientation and parallel with a cup sidewall, the back-plate portion has a planar back-plate front surface lower portion continuous with the base top surface, a planar back-plate right side surface, and a planar back-plate left side surface opposite the back-plate right side surface;

a planar projection portion spanning a width between the back-plate right side surface and the back-plate left side surface, the planar projection portion has a front surface attached to a rear portion of the cup rim, superjacent the projection portion is a stepped portion that gradually tapers down in a plurality of stepped elements to a planar back-plate front surface upper portion, and a planar back-plate rear surface is opposite the back-plate front surface lower portion, the projection portion, the stepped portion, and the back-plate front surface upper portion;

a peg attached to the back-plate portion, the peg is affixed to a location on the back-plate rear surface and extends rearwardly therefrom, the peg is located along a longitudinal centerline bisecting the back-plate rear surface to provide proper balance when the holder is suspended from a support surface via the peg; and, centerline bisecting the back-plate rear surface to provide proper balance when the holder is suspended from a support surface via the peg; and, a bracket portion attached to and extending rearwardly from the back-plate rear surface, subjacent the peg and opposite the back-plate front surface lower portion, the bracket portion has a bracket side portion that is affixed to the back-plate portion at a perpendicular angle, the bracket side portion has a planar bracket side portion left side surface that is coextensive with the back-plate left side surface and a planar bracket side portion right side surface opposite the bracket side portion left side surface, the bracket side portion also has a planar bracket side portion bottom surface coextensive with the base bottom surface, and a planar bracket side portion upper surface, opposite the bracket side portion bottom surface, the bracket portion also has a rear portion that is affixed to a terminal end of the side portion of the bracket portion and extends away perpendicularly therefrom, the bracket rear portion has a planar bracket rear portion upper surface that is coextensive with the bracket side portion upper surface and a planar bracket rear portion bottom surface, opposite the bracket rear portion upper surface, that is continuous with the bracket side portion bottom surface, the bracket rear portion also has a planar bracket rear portion front surface coextensive with the bracket side portion right side surface and faces the back-plate rear surface, a planar bracket rear portion rear surface is located opposite the bracket rear portion front surface, and the bracket rear portion also has a bracket rear portion right side surface which is opposite the bracket side portion left side portion.

2. The beverage holder according to claim 1, wherein the cup includes a cup sidewall that is generally cylindrical in shape.

3. The beverage holder according to claim 1, wherein the cup rim has a rear portion that is affixed with a projection surface of the back-plate portion.

4. The beverage holder according to claim 1, wherein the cup rim has a rear portion that is integral with a projection surface of the back-plate portion.

5. The beverage holder according to claim 1, wherein the cup bottom wall gently transitions from the cup sidewall such that an interior surface of the cup sidewall and the cup bottom wall upper surface is a smooth and continuous surface and does not have any sharp corners.

6. The beverage holder according to claim 1, wherein the cup bottom wall has an overall diameter slightly greater than a width of the base portion, such that a portion of the cup bottom wall bottom surface is visible in a bottom plan view of the holder.

7. The beverage holder according to claim 1, wherein the cup interior is thus defined by the cup bottom wall, the cup sidewall and a planar area between inner edges of the cup rim.

8. The beverage holder according to claim 1, wherein the base portion is generally square and has a width slightly less than the diameter of the cup.

9. The beverage holder according to claim 1, wherein the base portion is generally rectangular and has a width slightly less than the diameter of the cup.

10. The beverage holder according to claim 1, wherein the back-plate front surface upper portion has a thickness less than that of the back-plate front surface lower portion.

11. The beverage holder according to claim 1, wherein the back-plate front surface lower portion has a thickness equal to that of the base portion, such that the back-plate right side surface is continuous with the base right side surface and the back-plate left side surface is continuous with the base left side surface at this location.

12. The beverage holder according to claim 1, wherein the back-plate right side surface and the back-plate left side surface remains planar and follows an overall thickness of the back-plate portion.

13. The beverage holder according to claim 1, further comprising a gap defined by a boundary of a rear side of the cup sidewall, a rear of the cup rim, the projection portion, the back-plate front surface lower portion, and the base upper surface.

14. The beverage holder according to claim 1, wherein the peg is a cylindrical element with a terminal distal end, opposite the back-plate rear surface, that is smoothly rounded and has no sharp edges.

15. The beverage holder according to claim 14, wherein the terminal distal end is configured to snugly insert the peg into a rounded bore hole.

16. The beverage holder according to claim 1, wherein the peg is located superjacent to the cup.

17. The beverage holder according to claim 1, wherein a length that the bracket side portion extends rearwardly away from the back-plate portion, and the length that the bracket rear portion extends away from the bracket side portion is defined as a bracket gap.

18. The beverage holder according to claim 1, wherein the beverage holder is manufactured in a unitary fabrication and the cup, the base portion, the back-plate portion, the peg, and the bracket portion are integrally formed.

19. The beverage holder according to claim 1, wherein the beverage holder is manufactured in a unitary fabrication and the cup, the base portion, the back-plate portion, the peg, and the bracket portion are affixed, bonded, or attached to each other to provide an integral device.

20. The beverage holder according to claim 1, wherein the beverage holder is made of material selected from the group consisting of waterproof material, inert material, resilient to damage material, resistant to staining material, and capable of being easily cleaned material.

* * * * *